United States Patent [19]

Naoki et al.

[11] Patent Number: 4,755,645

[45] Date of Patent: Jul. 5, 1988

[54] PUSH BUTTON SWITCH

[75] Inventors: Kunimine Naoki; Hokari Shoji; Tachibana Sadao, all of Tokyo, Japan

[73] Assignee: Oki Electric Industry Co., Ltd., Tokyo, Japan

[21] Appl. No.: 88,024

[22] Filed: Aug. 18, 1987

Related U.S. Application Data

[63] Continuation of Ser. No. 895,162, Aug. 11, 1986, abandoned.

[30] Foreign Application Priority Data

Aug. 14, 1985 [JP] Japan ..... 60-123992[U]

[51] Int. Cl.[4] ..... H01H 13/00

[52] U.S. Cl. ..... 200/340; 200/290; 200/159 B

[58] Field of Search ..... 200/340, 5 A, 159 R, 200/159 B, 250, 276, 290

[56] References Cited

U.S. PATENT DOCUMENTS

| | | | |
|---|---|---|---|
| 4,313,685 | 2/1982 | Stahl et al. | 200/159 R |
| 4,468,542 | 8/1984 | Pounds | 200/340 |
| 4,529,848 | 7/1985 | Cherry | 200/5 A |

OTHER PUBLICATIONS

Word Processor File Keyboards, ESU—22 and ESU—21, Matsushita Electrical Co., Ltd.

*Primary Examiner*—Henry J. Recla
*Assistant Examiner*—Linda J. Sholl
*Attorney, Agent, or Firm*—Brumbaugh, Graves, Donohue & Raymond

[57] ABSTRACT

A coil spring constituting a pushbutton switch includes an intermediate diameter coil spring part serving as a tension spring coil spring part serving to depress a movable contact. This reduces the number of parts being needed. In addition, a housing guides a pushbutton support arm fixedly inserted into a groove formed between the casing and a guide part and the tip end of the support arm is adapted to strike the bottom of the housing in depression of the pushbutton and is thereby stopped, while the tip end is stopped by a stopper when the support arm is returned. Moreover, a projection part of a pushbutton body is pushed into the coil spring whereby the intermediate coil spring part is elongated while the small diameter coil part is contracted for closing the contacts, the contacts thereupon being released by the return of the pushbutton.

5 Claims, 2 Drawing Sheets

PUSH BUTTON SWITCH

This application is a continuation of application Ser. No. 895,162, filed on Aug. 11, 1986, now abandoned.

BACKGROUND OF THE INVENTION

1. Field of the Invention:

The present invention relates to a structure of a pushbutton switch for use in a key board, etc., of electronic equipments.

2. Description of the Related Art:

Many related techniques in such a field employ in general a system including a movable contact fixedly mounted on a flexible member and a fixed contact separated away in a confronting relation from the movable contact for making and breaking a switch by making use of deformation of the flexible member caused by pressing it.

To make useable a contact of this type for those such as a full key board where importance is attached to a feeling of depressing it, the structure thereof should be adapted to have a mechanism to alter a stroke such as a coil spring between a pushbutton and a flexible member for conducting secure make-and-brake operation of the contact while increasing the stroke of depressing the pushbutton and depressing the contact with uniform depression at all times. For such a prior technique, "Word Processor File Keyboards, ESU-22 and ESU-21" available from Matsushita Electric Industrial Co., Ltd. is known for example. A keybord of this type employs as shown in its catalogue a pushbutton switch having compression coil springs of different two diameters doubly structured coaxially. This assures a stroke of the pushbutton switch by permitting a slider part provided on the lower portion of a key top to reciprocate in contact in its outside with the inside of a switch body. The lower portion of the switch body includes a switch part provided thereon. A contact of this switch part is composed of a fixed contact provided on the upper surface of a base plate and of a movable contact formed on the lower surface of the flexible member separated away from the fixed contact relation via a spacer. One end of the inside coil spring adjoins the upper portion of the movable contact in an interval, while the other end thereof is mounted on the lower portion of the key top. Moreover, both ends of the outside coil spring are respectively mounted on the lower parts of the key top and the body. Depressed here the pushbutton switch arranged as such, the larger coil spring is compressed, while the smaller coil spring is brought into contact with the flexible member. Depressed furthermore the key top, both the springs are compressed, whereby the flexible member is depressed and deformed by the smaller coil spring to permit the movable contact to make contact with the fixed contact for closing the contact.

Continued the depression furthermore, the two springs are compressed corresponding to an excess stroke, whereby the key top is brought into contact with the body and stopped.

The contact after being closed is stably depressed by the smaller coil spring, so that chattering, etc., is prevented from being produced.

However, with the arrangement described above, separate two larger and smaller coil springs are needed. Accordingly, the number of parts being needed is increased. In addition, assembly thereof, is performed while compressing the coil spring, so that the cost for the assembly is increased due to troubles such as compression buckling of the coil spring, etc.

SUMMARY OF THE INVENTION

In view of the drawbacks of the prior technique, it is an object of the present invention to provide a pushbutton switch having a keyboard improved and simplified in a structure of parts constituting the keyboard.

Another object of the present invention is to reduce the number of parts constituting the pushbutton switch.

Still another object of the present invention is to provide a pushbutton switch having a single coil spring serving as two coil springs: one for returning the push button switch and the other for depressing the contact.

Another object of the present invention is to facilitate assembly of the keyboard and reduce the manhour of the assembly.

Further another object of the present invention is to provide initial tension to the coil spring of the pushbutton switch by pulling the coil spring upon assembling the pushbutton switch and thereby preventing any trouble from being produced.

To achieve the above object, a push button switch according to the present invention has a switch coil spring mounted on the lower portion of the pushbutton body provided slidably in a housing, the coil springs being adapted to return the pushbutton to the original state as well as depress a contact of the pushbutton. Namely, the pushbutton switch has a spring support part provided at the center of a base plate of a body, on the upper end of which support part one end of the coil spring is mounted and on the lower end of which a switch part is disposed adjoining thereto, which switch part has the other end of the coil spring arranged thereon. The coil spring is adapted to be a tension spring from the above one end thereof to a prescribed portion and to be a compression spring from the prescribed portion to the above other end. Accordingly, depressed the pushbutton, the other end of the coil spring mounted on the lower part of the body is brought into contact with the switch part. Depressed furthermore the pushbutton, the coil spring presses the switch part as a compression spring to close the contact. Releasing here the pushbutton as a tension spring to open the contact whereby the pushbutton is returned to the original position.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

A pushbutton switch according to the present invention will be described in detail with reference to the accompanying drawings.

Figure 1:
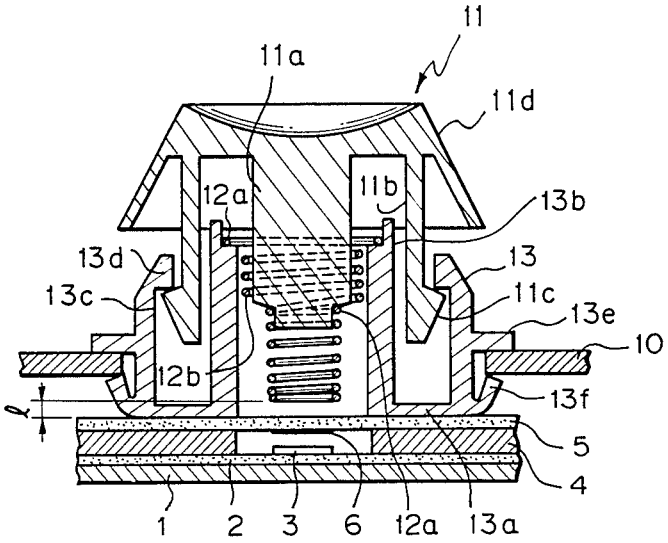
FIG. 1 is a cross-sectional view of an embodiment of a pushbutton switch according to the present invention illustrating a state of a pushbutton being released.
Figure 2:
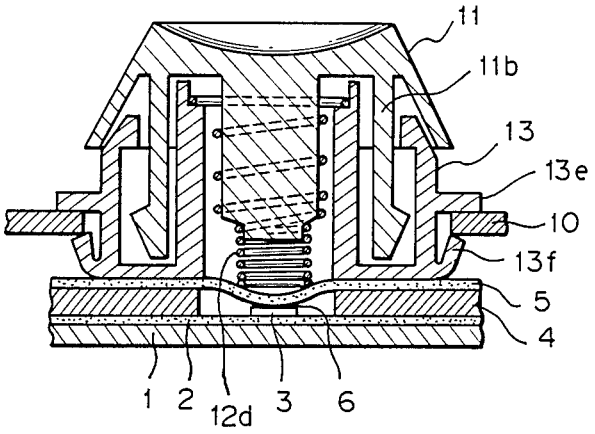
FIG. 2 is a cross-sectional view of an embodiment of a pushbutton switch of the present invention illustrating a state of a pushbutton being depressed.

Referring to FIGS. 1 and 2, an embodiment of a pushbutton switch according to the present invention is shown of a state of a pushbutton being depressed and a state of the same pushbutton being released.

Figure 3:
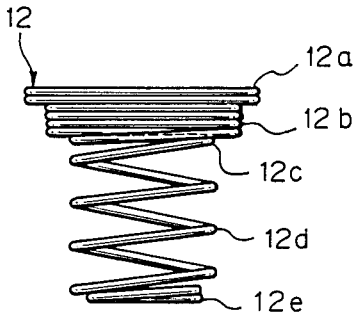
FIG. 3 is a view illustrating details of a coil spring according to the present invention.

In the same figures, designated at 1 is an insulating base plate comprising synthetic resin, 2 is a flexible printed circuit board comprising synthetic resin provided in the insulating base plate 1, 3 is a fixed contact provided on the upper surface of the printed circuit board 2, 4 is an insulating spacer, 5 is a flexible printed circuit board comprising synthetic resin, 6 is a movable contact provided on the lower surface of the printed circuit board 5. Likewise, designated at 11 is a pushbutton, including a projection part 11*a* provided on the lower surface of the pushbutton at the center thereof, a support arm 11*b* projected to the outside of the projection part 11*a*, a slanted pawl 11*c* for engagement provided on the tip of the support arm 11*b*, and a pushbutton 11*d*. In addition, designated at 12 is a coil spring having, as shown in FIG. 3 illustrating details of a structure of the coil spring, a large diameter base winding part 12*a* formed on the upper end part of the coil spring, and successively in order an intermediate diameter tension coil spring part 12*b*, a parallel winding part 12*e*, a small diameter compression coil spring part 12*d*, and a small diameter base winding part 12*e* formed together integrally. Furthermore, designated at 13 is a housing including a button surface 13*a*, a spring seat casing 13*b*, a guide part 13*c* for the support arm 11*b* of the pushbutton, the guide part forming an inner peripheral edge of the housing 13, a stopper part 13*d* projecting interiorly of the upper end of the housing 13, a flange 13*e*, and a locking panel 13*f* for holding a bracket 10 for mounting the switch between the flange 13*e* and the locking pawl 13*f*. Moreover, a gap 1 is provided between the lower end part of the coil spring 12 and the flexible printed circuit board 5.

In succession, a method of assembling the pushbutton switch with the respective parts described above will be described.

First, dropping the coil spring 12 into a through-hole in the spring seat casing 13*b* provided at the center of the housing 13 while directing the small diameter seat winding part being the lowest end of the coil spring downwardly, the large diameter seat winding part 12*a* is brought into contact with the upper end stepped part of the spring seat casing 13*b* to restrict the position of the coil spring 12, whereby a prescribed distance is left behind between the lower end small diameter seat winding part 12*e* of the coil spring 12 and the flexible printed circuit board 5. Then, to mount the pushbutton, the slanted portion 11*e* of the tip of the pushbutton 11 support arm 11*b* is inserted into an insertion hole formed between the housing 13 and the spring seat casing 13*b* while being guided by the stopper part 13*d* of the housing 13. Pushing down the pushbutton 11 furthermore, the support arm 11*b* of the pushbutton is elastically deformed whereby the slanted pawl 11*c* of the tip of the support arm goes over the stopper part 13*d* of the housing 13.

Hereupon, the projection part 11*a* of the pushbutton 11 penetrates the intermediate tension coil spring part 12*b* and makes contact with the parallel winding part 12*c* provided at a connecting portion between the tension and compression coil spring parts 12*b*, 12*d* of the coil spring 12. While, since the large diameter seat winding part 12*a* of the coil spring 12 is restricted positionablly by the stepped part provided interiorly of the upper end of the spring seat part 13*b* of the housing 13, the intermediate diameter tension coil spring part 12*b* is slightly rendered to tension, and hence elongated. Thus, the pushbutton projection part 11*a* is subjected to force serving to push it back caused by the coil spring 12, whereby the projection part is brought into contact with the housing stopper part 13*b*, stopped, and positioned. In addition, an interval 1 is left behind between the tip end 12*e* of the coil spring 12 and the flexible member 8. Thus the assembly of the pushbutton switch is completed as described above.

Then, operation of the present embodiment assembled as such will be described.

As shown in FIG. 1, depressed the pushbutton body 11*d*, the pushbutton 11 is lowered following the guide part 13*a* of the housing 13 parallel thereto to permit the pushbutton projection part 11*a* to apply force to the parallel winding part 12*c* of the coil spring 12, whereby the large tension diameter compression coil spring part 12*b* is elongated. While, since the small diameter coil spring 12*d* has a desired interval 1 between the flexible member 8 and the small diameter seat winding part 12*e*, it is never deformed until the end surface of the small diameter seat winding part 12*e* makes contact with the flexible printed circuit board 5.

Depressed furthermore the pushbutton, the small diameter seat winding part 12*e* makes contact with the flexible printed circuit board 5 to press the small diameter coil spring part 12*d*, whereby the small diameter coil spring part starts to be compressed and deformed. Hereupon, the flexible printed circuit board 5 is deformed in response to pressure of depression from the small diameter compression coil spring part 12*d*, and furthermore depressed the pushbutton, the movable contact 9 is brought into contact with the fixed contact 6 for closing the contacts. Still more the pushbutton 11 is not yet allowed to reach the limit of lowering at the moment the contacts are closed with each other as described above, and furthermore allowed to lower until the pushbutton 11 makes contact with the stopper (not shown) provided in the housing.

Furthermore, although the flexible printed circuit boards 2 and 5 were employed in the present embodiment for the switch part, any wired flexible member may be employed without being limited thereto. Moreover, for the base plate 2, the base plate 1 may be employed instead of it. In addition, for the switch part, an electrostatic capacitance type may be employed without limiting it to a mechanical one.

Although a certain preferred embodiment has been shown and described, it should be understood that many changes and modifications may be made therein without departing from the scope of the appended claims.

What is claimed is:

1. A pushbutton switch comprising a pushbutton body, a housing, a coil spring mounted on the lower portion of said pushbutton body provided slidably in said housing and a switch part provided on said housing downwardly of said coil spring, said switch part is actuated by said pushbutton body, characterized in that said pushbutton switch includes (a) said coil spring composed of a tension spring and a compression spring formed integrally with each other;

(b) a spring seat casing provided at the center of said housing;

(c) a projection part provided on the lower part of the pushbutton body; and (d) said tension spring being supported at one end thereof by said spring seat casing and at the opposite end thereof by said projection part, while said compression spring being engagable at one end thereof with said switch part and engaged at the other end thereof with said projection part, said spring seat casing having a through hole which is opened at the upper end thereof such that during asembly of said pushbutton switch, said coil spring and said projection part may be inserted into said casing through the opened end of said through-hole, said housing having an upper side, said housing further having means to engage said pushbutton body and prevent said projection part from being withdrawn from said spring seat casing once said projection part is inserted therein, the result being that said pushbutton switch may be completely assembled from the upper side of said housing.

2. A pushbutton switch according to claim 1, wherein the one end of the tension spring has a base winding with a larger diameter than that of a second portion thereof, and said compression spring has a smaller diameter than that of the second portion of the tension spring.

3. A pushbutton switch according to claim 1, wherein said switch part consists of a fixed contact and a movable contact.

4. A pushbutton switch according to claim 2 wherein said base winding is supported in an upper portion of said spring seat casing, and said second portion of said tension spring substantially surrounds said projection part, such that when the projection part is inserted in said casing and engages said compression spring and said pushbutton body engages said means, said tension spring is rendered at least partially under tension.

5. A pushbutton switch according to claim 4 wherein said means to engage said pushbutton body and prevent said projection part from being withdrawn from said spring seat casing includes a stopper part on the housing which will elastically deform a support arm on the pushbutton as the pushbutton projection is inserted into said casing and thence permit said support arm to be snap engaged by said stopper part.

* * * * *

UNITED STATES PATENT AND TRADEMARK OFFICE

CERTIFICATE OF CORRECTION

PATENT NO. : 4,755,645

DATED : July 5, 1988

INVENTOR(S) : Naoki et. al.

It is certified that error appears in the above-identified patent and that said Letters Patent are hereby corrected as shown below:

Column 4, line 25, "tension diameter compression" should read --diameter tension--; line 26, after "diameter" insert --compression--; Column 5, line 16, "asembly" should read --assembly--.

Signed and Sealed this

Sixth Day of December, 1988

*Attest:*

DONALD J. QUIGG

*Attesting Officer*

*Commissioner of Patents and Trademarks*